US012790901B2

(12) United States Patent
Velez et al.

(10) Patent No.: US 12,790,901 B2
(45) Date of Patent: Nov. 10, 2026

(54) WELL RIG WITH TUBING ANTI-BUCKLING SYSTEM AND METHOD

(71) Applicant: Cudd Pressure Control, Inc., The Woodlands, TX (US)

(72) Inventors: Juan Velez, Montgomery, TX (US); Dustin Locklear, Moore, OK (US); Roger L. Schultz, Ninnekah, OK (US); Andrew M. Ferguson, Moore, OK (US)

(73) Assignee: CUDD PRESSURE CONTROL, INC., The Woodlands, TX (US)

( * ) Notice: Subject to any disclaimer, the term of this patent is extended or adjusted under 35 U.S.C. 154(b) by 0 days.

(21) Appl. No.: 19/304,060

(22) Filed: Aug. 19, 2025

(65) Prior Publication Data

US 2026/0055676 A1 Feb. 26, 2026

Related U.S. Application Data

(60) Provisional application No. 63/685,231, filed on Aug. 20, 2024.

(51) Int. Cl.
*E21B 15/04* (2006.01)
*E21B 7/02* (2006.01)
(Continued)

(52) U.S. Cl.
CPC ..... *E21B 15/045* (2013.01); *E21B 7/023* (2013.01); *E21B 15/00* (2013.01); *E21B 19/165* (2013.01); *E21B 19/24* (2013.01); *E21B 33/03* (2013.01)

(58) Field of Classification Search
CPC .. E21B 15/00–006; E21B 7/023; E21B 19/00; E21B 19/24; E21B 19/02; E21B 19/06; E21B 19/08; E21B 19/165
See application file for complete search history.

(56) References Cited

U.S. PATENT DOCUMENTS 3,508,409 A 4/1970 Cargile, Jr.
4,290,495 A 9/1981 Elliston
(Continued)

FOREIGN PATENT DOCUMENTS

CA 2950920 A1 6/2017
CA 3008007 A1 6/2017
(Continued)

OTHER PUBLICATIONS

Aei Supplies, "Snubbing Units", product description, 8 pages, dated Jun. 20, 2024.
(Continued)

*Primary Examiner* — Kristyn A Hall
(74) *Attorney, Agent, or Firm* — Smith IP Services, P.C.

(57) ABSTRACT

A well rig can include a mast, and multiple guide assemblies distributed along the mast. The guide assemblies are configured to laterally support a tubular string. A method of operating a well rig can include mounting multiple guide assemblies spaced apart along a length of a mast of the well rig, and actuating each of the guide assemblies between open and closed configurations. In the open configuration the guide assembly does not laterally support a tubular string, and in the closed configuration the guide assembly laterally supports the tubular string. Another method can include mounting multiple guide assemblies spaced apart along a length of a mast of a well rig, and displacing a top drive along the mast. The guide assemblies open in succession as the top drive descends along the mast, and the guide assemblies close in succession as the top drive ascends along the mast.

22 Claims, 7 Drawing Sheets

(51) Int. Cl.

| | |
|---|---|
| ***E21B 15/00*** | (2006.01) |
| ***E21B 19/16*** | (2006.01) |
| ***E21B 19/24*** | (2006.01) |
| ***E21B 33/03*** | (2006.01) |

(56) References Cited

U.S. PATENT DOCUMENTS

| | | | | |
|---|---|---|---|---|
| 6,283,203 | B1 * | 9/2001 | Eilertsen | E21B 19/00 166/85.5 |
| 8,733,213 | B2 | 5/2014 | Taggart | |
| 9,238,947 | B2 | 1/2016 | Kallal | |
| 9,316,056 | B1 | 4/2016 | Smith | |
| 10,711,523 | B2 | 7/2020 | Taggart et al. | |
| 2005/0126790 | A1 | 6/2005 | Beato et al. | |
| 2013/0341038 | A1 | 12/2013 | Flusche | |
| 2014/0076583 | A1 | 3/2014 | Robichaux et al. | |
| 2017/0314345 | A1 * | 11/2017 | Flusche | E21B 19/16 |
| 2018/0023346 | A1 * | 1/2018 | Taggart | E21B 19/083 175/57 |
| 2018/0100378 | A1 | 4/2018 | Hardy | |
| 2020/0199976 | A1 | 6/2020 | Stahl et al. | |
| 2026/0055670 | A1 | 2/2026 | Velez et al. | |
| 2026/0055671 | A1 | 2/2026 | Velez et al. | |

FOREIGN PATENT DOCUMENTS

| | | | |
|---|---|---|---|
| CA | 2952071 | A1 | 8/2017 |
| CA | 2958393 | A1 | 4/2018 |

OTHER PUBLICATIONS

National Oilwell Varco, "Hydra Rig(TM) Short Stroke Snubbing Unit", product brochure, 1 page dated 2017.

Prostar Energy, "Company Overview Jun. 2024", presentation, 25 pages, dated Jun. 2024.

Office Action issued Mar. 25, 2026 for U.S. Appl. No. 19/303,961, 22 pages.

Office Action issued Jan. 30, 2026 for U.S. Appl. No. 19/304,016, 18 pages.

* cited by examiner

WELL RIG WITH TUBING ANTI-BUCKLING SYSTEM AND METHOD

CROSS-REFERENCE TO RELATED APPLICATION

This application claims the benefit of the filing date of U.S. provisional application No. 63/685,231 filed on 20 Aug. 2024. The entire disclosure of the prior application is incorporated herein by this reference for all purposes.

BACKGROUND

This disclosure relates generally to equipment utilized and operations performed in conjunction with a subterranean well and, in an example described below, more particularly provides for prevention of tubing buckling for a well rig.

When performing well operations using a mobile well rig, a tubular string is typically displaced into and/or out of a well. The rig is typically provided with snubbing equipment if it is expected that the well will be pressurized at the surface during the well operations.

Therefore, it will be readily appreciated that improvements are continually needed in the art of constructing and utilizing well rigs. The present disclosure provides such improvements, which may be used with a variety of different types of well operations, whether or not snubbing equipment is also used in the well operations.

DETAILED DESCRIPTION

Figure 1:
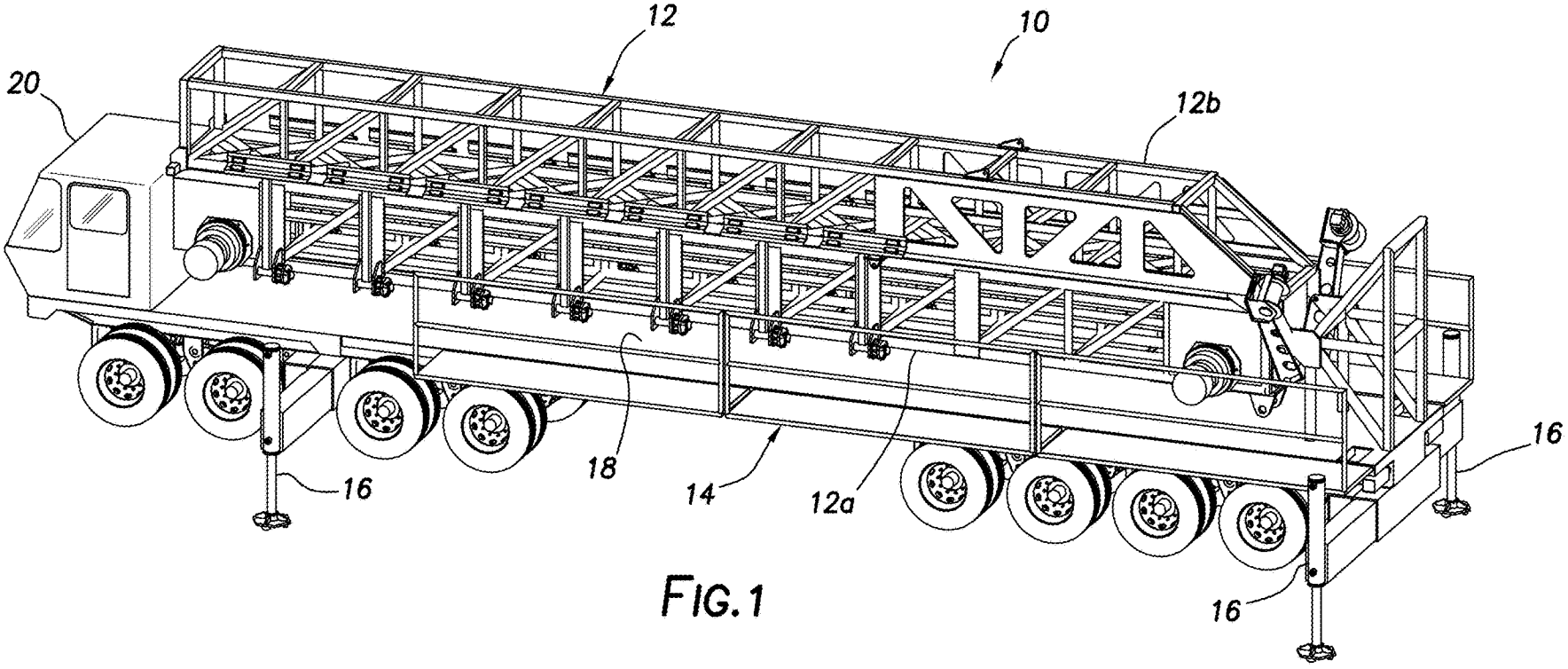
FIG. 1 is a representative perspective view of an example of a mobile well rig and associated method which can embody principles of this disclosure.

Representatively illustrated in FIG. 1 is a well rig 10 and associated method which can embody principles of this disclosure. However, it should be clearly understood that the rig 10 and method are merely one example of an application of the principles of this disclosure in practice, and a wide variety of other examples are possible. Therefore, the scope of this disclosure is not limited at all to the details of the rig 10 and method described herein and/or depicted in the drawings.

In one aspect of the present disclosure, a system that can be fully integrated into a well rig is disclosed, which in one example comprises a structural apparatus to support tubing and prevent buckling as it is run into or out of a well. The system can be particularly useful in well operations in which tubulars are "snubbed" into or out of the well.

An anti-buckle tubular guide system is disclosed herein that limits unsupported lengths of tubulars under snub load. The anti-buckle tubular guide system is configured to cooperate with a top drive system, so that the anti-buckle feature is maintained as the top drive displaces along a mast of the well rig.

In one embodiment, the anti-buckle tubular guide system is structurally and mechanically integrated into an upper mast section for the purpose of minimizing unsupported tubing length under snub loads. The anti-buckle tubular guide system comprises multiple guide assemblies arranged in a segmented configuration that encloses around tubulars to provide lateral support and structurally resist bending of the tubulars under snub loads.

Each guide assembly can be independently and dynamically adjusted in real-time based on the overall amount of unsupported tubular length. Hydraulic cylinders and/or electric motors open and close each guide assembly either through a rotating arm mechanism. In some examples, a track system may be used to displace the guides.

When the top drive is descending, the guide assemblies can automatically open in succession, beginning with the uppermost closed guide assembly. When the top drive is ascending, the guide assemblies can automatically close in succession, beginning with the lowermost open guide assembly.

Each guide assembly may include a sensor to detect when the top drive is approaching or departing. For example, a proximity sensor, a linear displacement sensor, a Hall effect device, etc., may be used. Alternatively, or in addition, the top drive system may include a position control feature that provides an indication of the position of the top drive. A control system for the guide assemblies can use the sensors and/or top drive position indication to determine when each guide assembly should be automatically opened or closed when the top drive is respectively descending or ascending.

Referring specifically now to FIG. 1, a representative perspective view of an example of the mobile well rig 10 and associated method is depicted. In this example, the mobile well rig 10 comprises a mast 12 mounted on a transport vehicle 14.

As depicted in FIG. 1, the rig 10 is appropriately positioned proximate a wellhead (not shown in FIG. 1, see FIG. 4), and outriggers 16 of the transport vehicle 14 have been deployed to support a generally horizontal bed or platform 18 on which the mast is pivotably mounted. The mast 12 is stored for transport on the platform 18 rearward of a cab 20 of the transport vehicle 14.

The mast 12 is in a folded configuration as depicted in FIG. 1. An upper section 12*a* of the mast 12 is positioned between the platform 18 and a lower section 12*b* of the mast.

Figure 2:
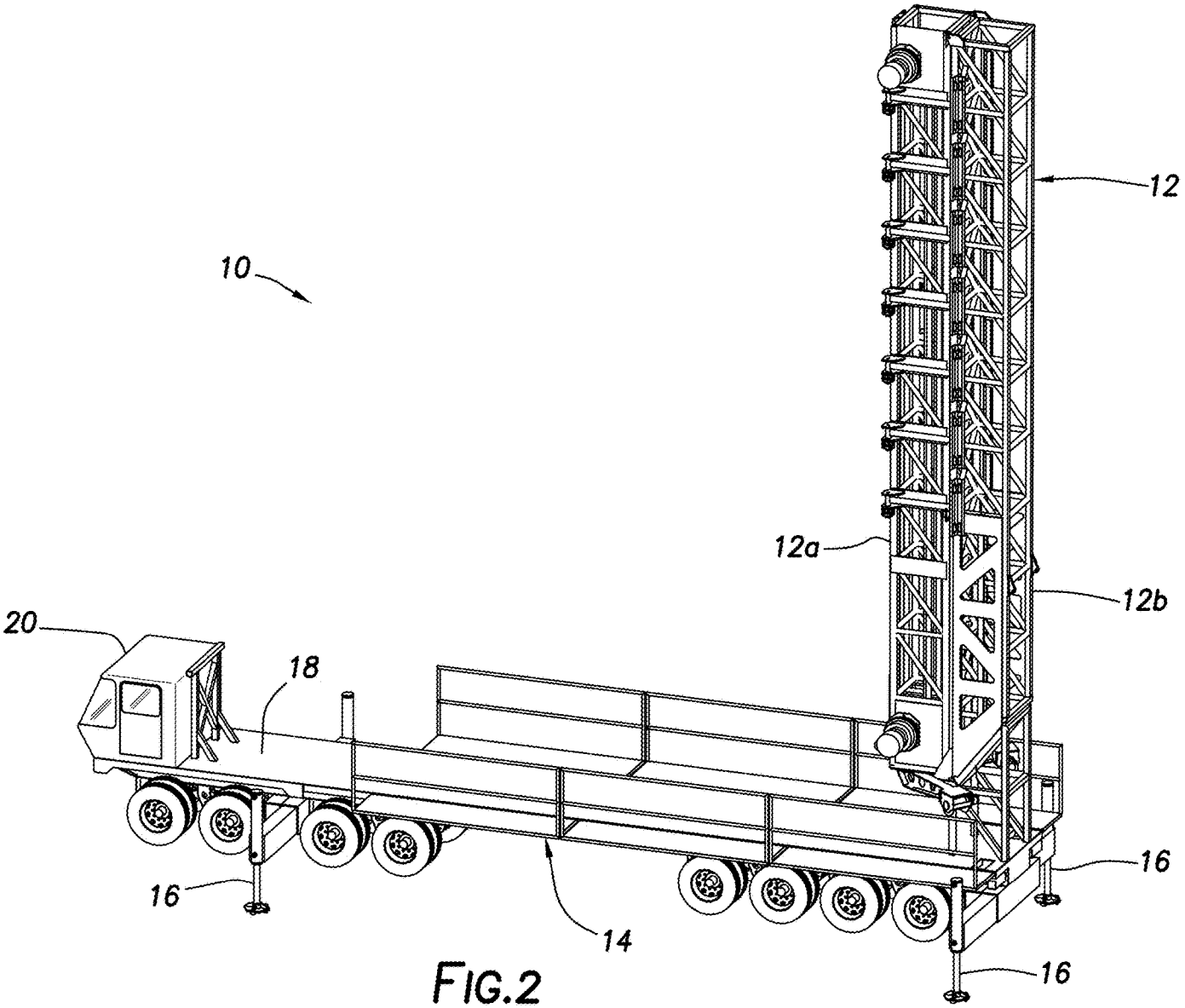
FIG. 2 is a representative perspective view of the rig, with a mast of the rig partially raised.

Referring additionally now to FIG. 2, a representative perspective view of the rig 10, with the mast 12 partially raised is depicted. In this view, the lower mast section 12*b* has been pivoted upward from the platform 18, so that the lower mast is now vertical. In some examples, the lower mast section 12*b* could be raised to an inclined position relative to the platform 18 (such as, when used with a slant well).

Note that the upper mast section 12*a* is also in a vertical orientation at this point as depicted in FIG. 2, although it remains folded against the lower mast 12*b*. The upper mast section 12*a* is positioned between the lower mast section 12*b* and the cab 20 of the transport vehicle 14.

Figure 3:
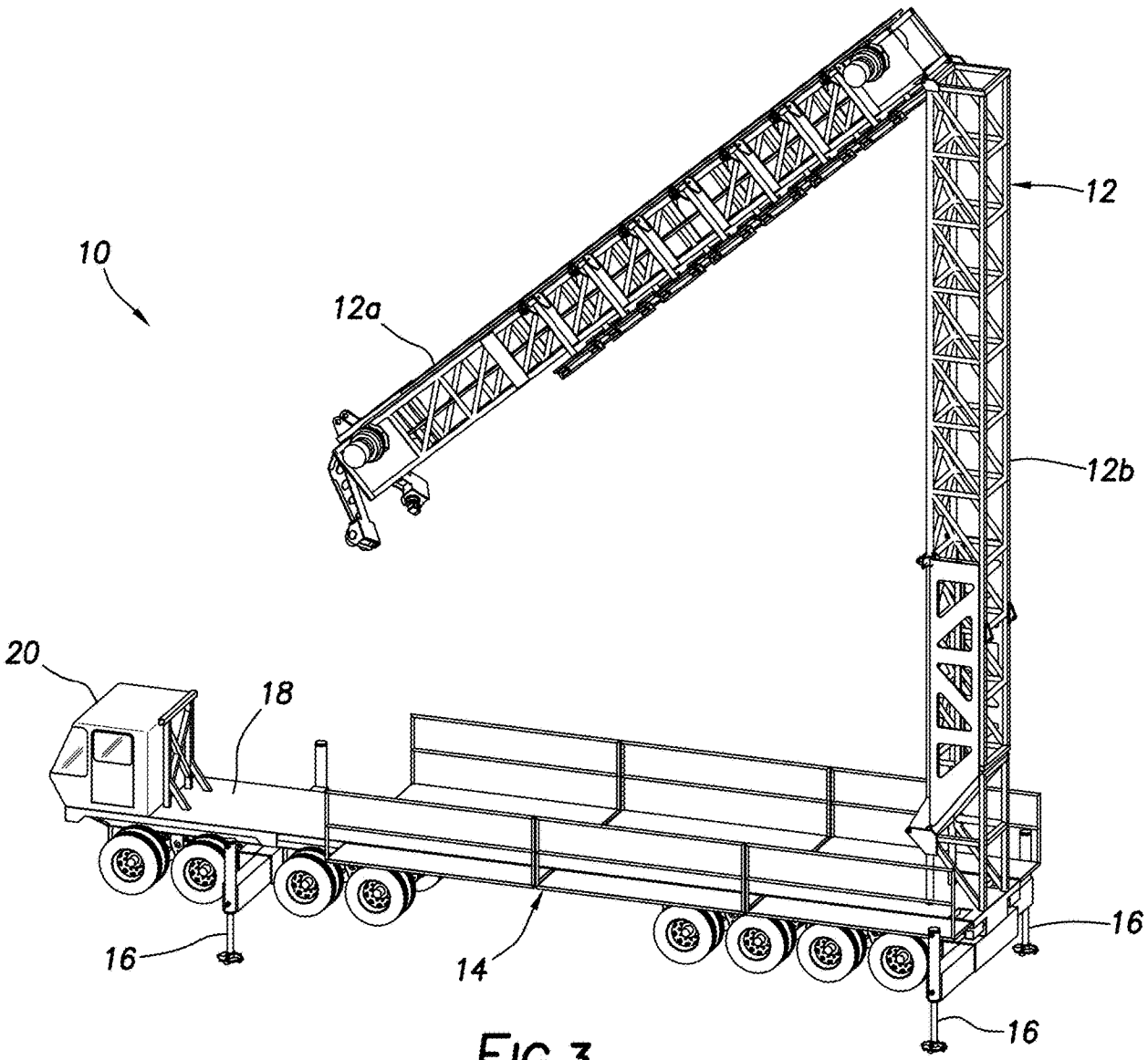
FIG. 3 is a representative perspective view of the rig, with the mast further raised.

Referring additionally now to FIG. 3, a representative perspective view of the rig 10, with the mast 12 further raised is depicted. In this view, the upper mast section 12*a* is being pivoted upward relative to the lower mast section 12*b*. When fully raised, the upper mast section 12*a* will be vertical and aligned with the lower mast section 12*b*.

Hydraulic cylinders (not shown in FIG. 3) or other suitable equipment (such as, a crane, a winch system, etc.) may be used to raise the mast 12 in other examples.

Figure 4:
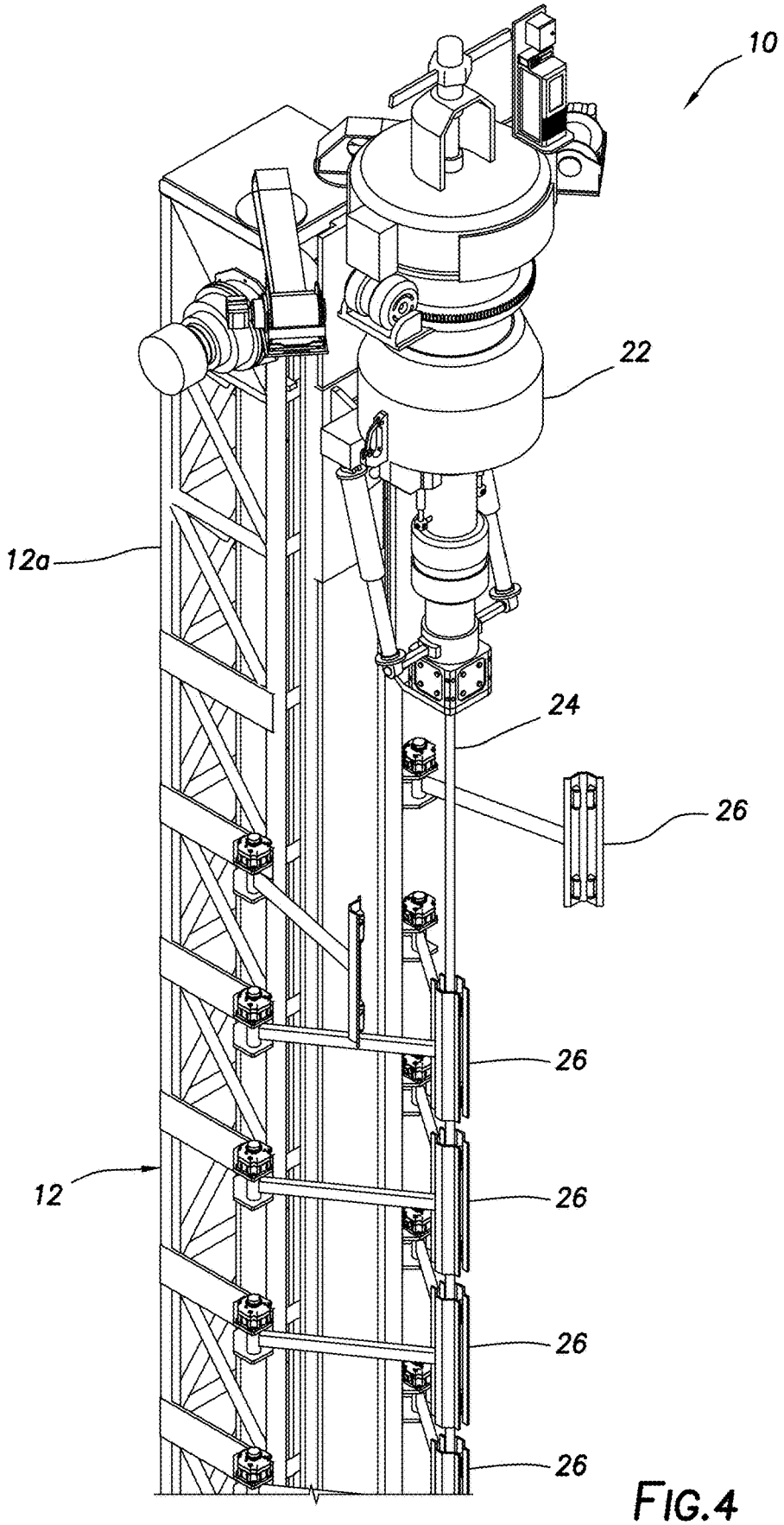
FIG. 4 is a representative perspective view of an example of an upper portion of a mast of the rig.

Referring additionally now to FIG. 4, a representative perspective view of an example of an upper portion of the mast 12 of the rig 10 is depicted. In this view, it may be seen that a top drive 22 is mounted for displacement along the upper mast section 12*a*. The top drive 22 suspends a tubular string 24 and displaces the tubular string upward and/or downward relative to the mast 12.

The top drive 22 is secured to an upper end of the tubular string 24. A lower section of the tubular string 24 is subjected to snub loading in this example, due to the well being pressurized at the surface. Thus, unless the tubular string 24 is laterally supported along its length, there is the possibility that the tubular string will buckle below the top drive 22.

To prevent buckling of the tubular string 24, the rig 10 includes multiple guide assemblies 26 distributed along the upper mast section 12*a*. Each of the guide assemblies 26 can be actuated between an open configuration in which the guide assembly does not laterally support the tubular string 24, and a closed configuration in which the guide assembly does laterally support the tubular string.

As depicted in FIG. 4, an uppermost one of the guide assemblies 26 is open and the rest of the guide assemblies are closed. As described more fully below, actuation of the guide assemblies 26 can be coordinated with displacement of the top drive 22 along the mast 12, so that the guide assemblies open in succession as the top drive descends, and the guide assemblies close in succession as the top drive ascends.

Figure 5:
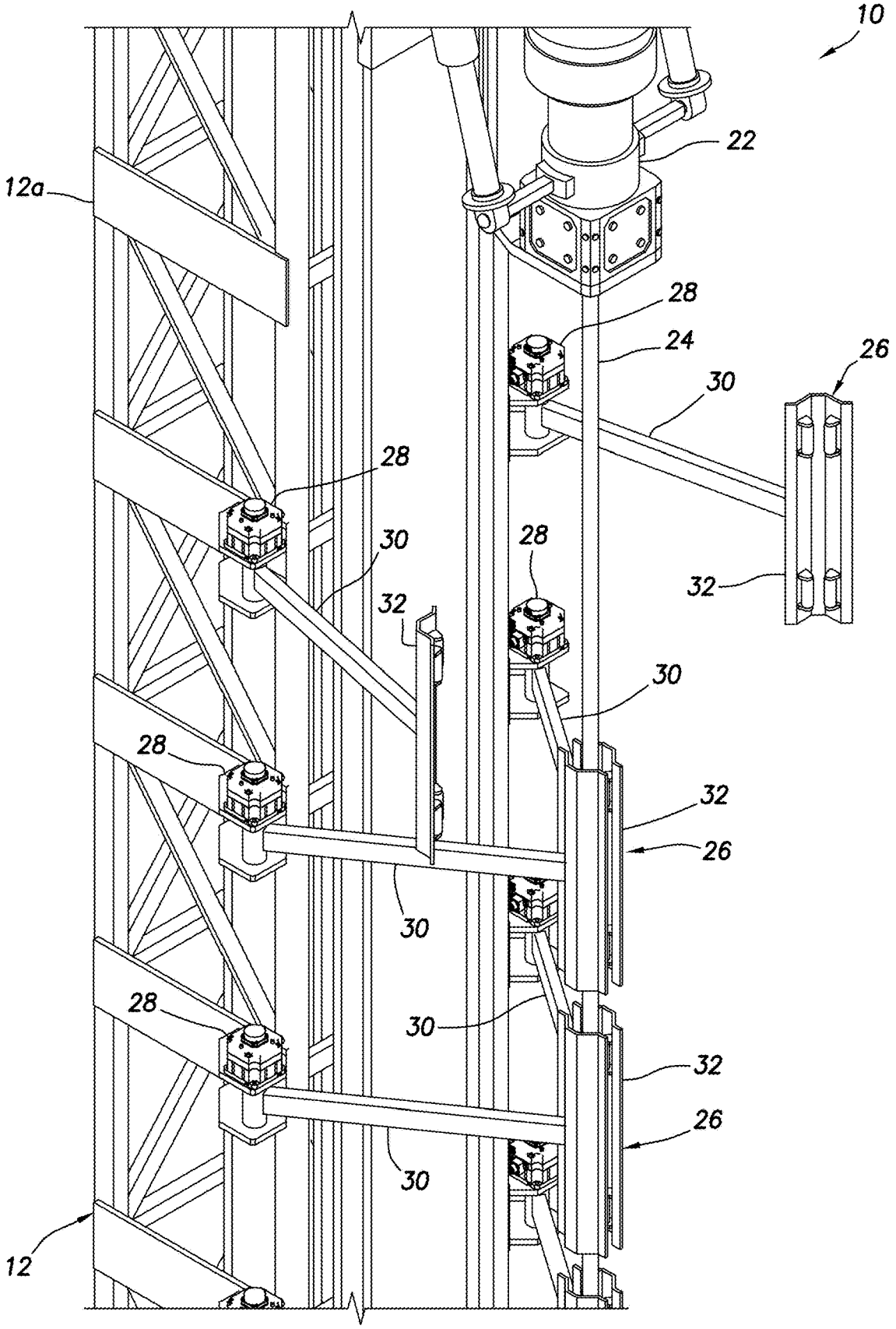
FIG. 5 is a representative perspective view of an example of guide assemblies mounted to the mast upper portion.

Referring additionally now to FIG. 5, a representative perspective view of the guide assemblies 26 mounted to the upper mast section 12*a* is depicted. In this view it may be seen that each of the guide assemblies 26 includes two sets of actuators 28, arms 30 and guides 32.

In this example, the actuators 28 are electrical rotary actuators that rotate the arms 30 and guides 32 between open and closed positions. In other examples, the actuators 28 could be other types of actuators (such as, hydraulic actuators, linear actuators, etc.). It is not necessary for the guides 32 to be rotated between the open and closed positions.

In the closed position, each guide 32 will contact and laterally support the tubular string 24. In the open position, each guide 32 will be spaced apart from the tubular string 24 and will permit the top drive 22 to displace past the respective guide assembly 26.

Figure 6:
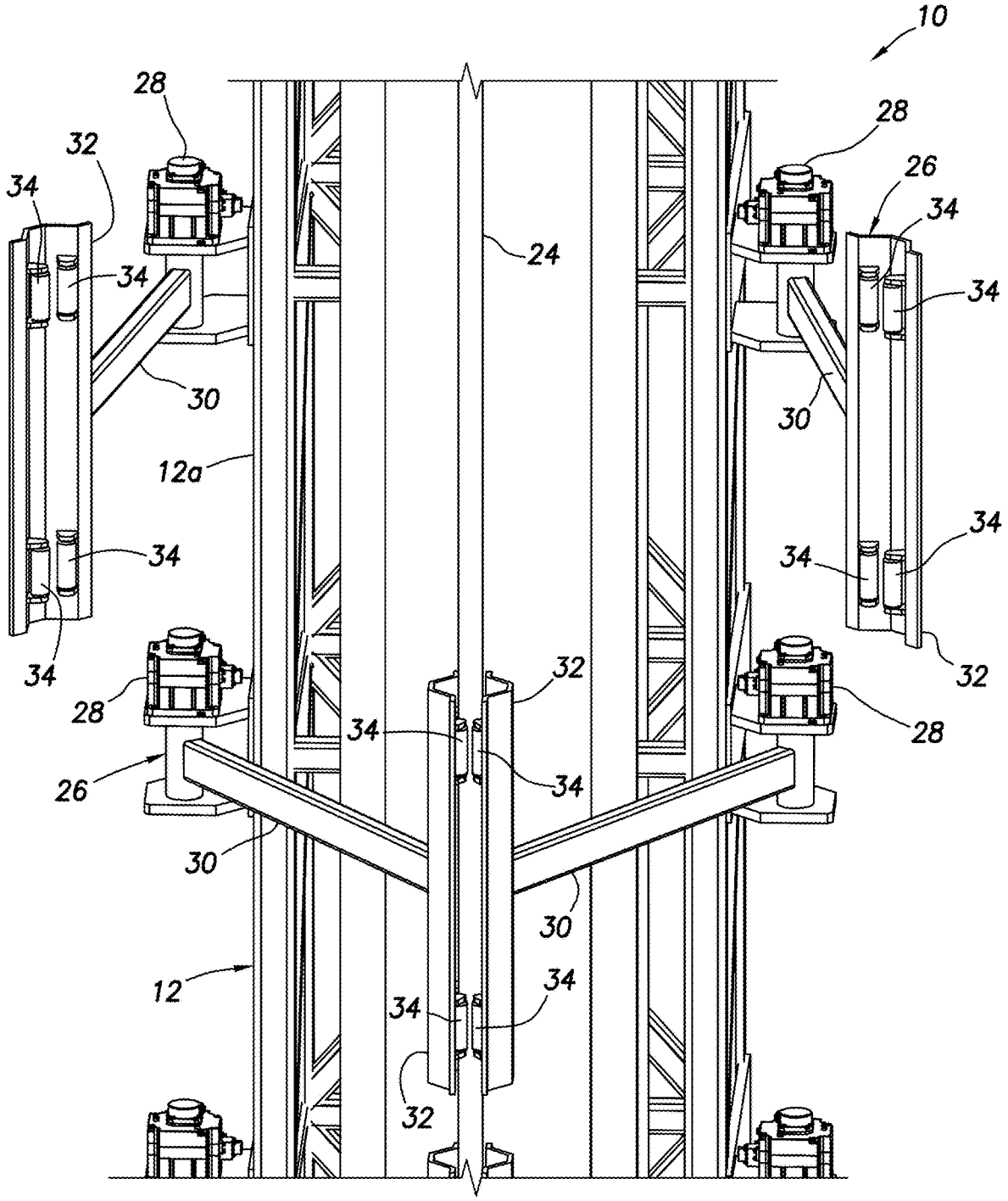
FIG. 6 is a representative side view of the guide assemblies in open and closed configurations.

Referring additionally now to FIG. 6, a representative side view of the guide assemblies 26 in open and closed configurations is depicted. In this view it may be seen that each of the guides 32 includes multiple rollers 34 for contacting and supporting the tubular string 24.

The rollers 34 are rotatably mounted in the guides 32, so that the rollers will rotate with the tubular string 24 when it is rotated by the top drive 22. The rollers 34 are also preferably made of a relatively low friction material, so that they do not substantially resist axial displacement of the tubular string 24 by the top drive 22.

Figure 7:
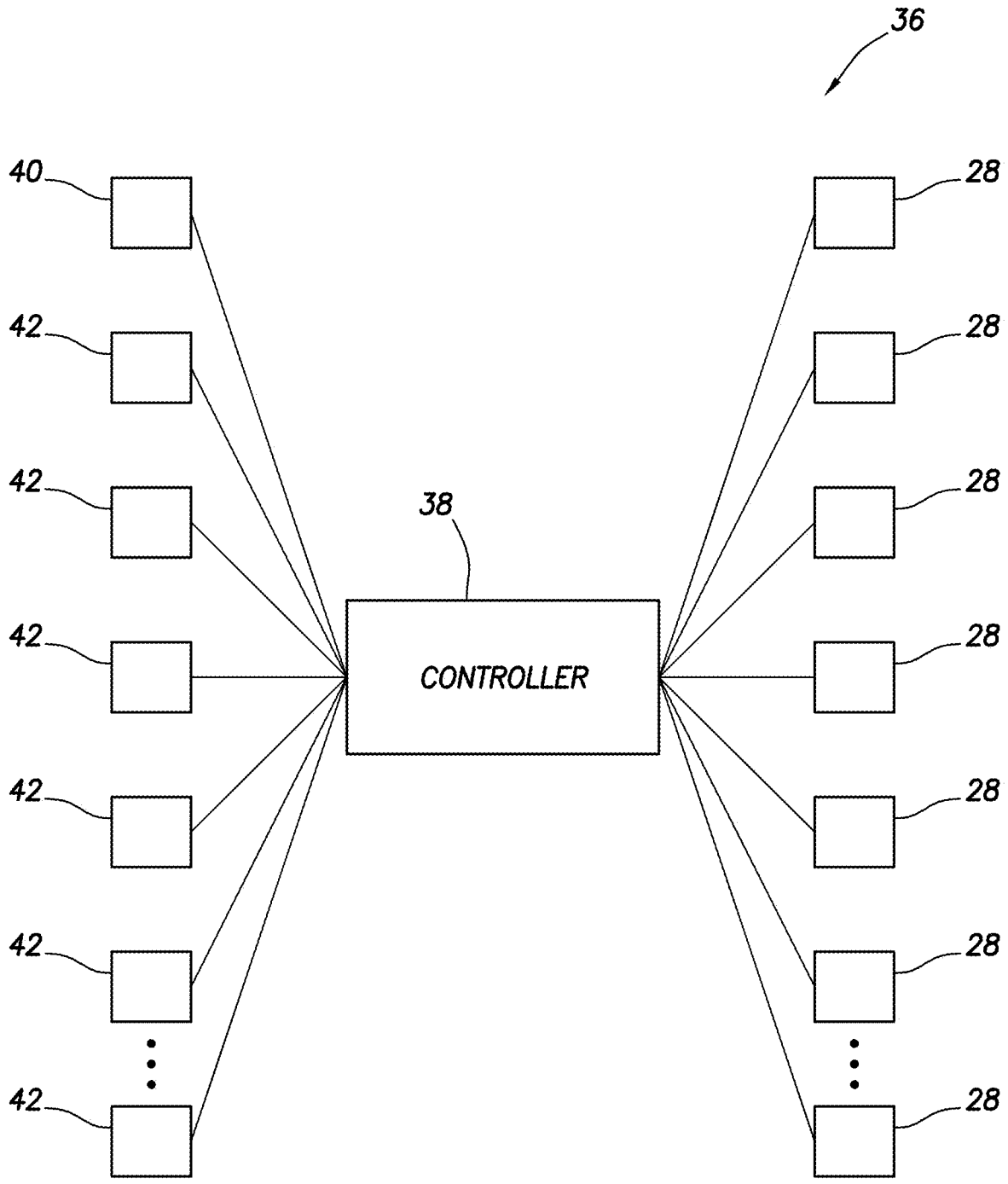
FIG. 7 is a schematic view of an example of a control system of the rig.

Referring additionally now to FIG. 7, a schematic view of an example of a control system 36 of the rig 10 is depicted. The control system 36 in this example controls operation of the actuators 28 of the guide assemblies 26 in coordination with the displacement of the top drive 22 along the mast 12.

In the FIG. 7 example, the control system 36 includes a controller 38 (such as, a programmable logic controller) that controls operation of the actuators 28. The controller 38 receives outputs of various sensors 40, 42 and operates the actuators 28 in response to the sensor outputs.

The sensor 40 in this example detects a position of the top drive 22 along the mast 12. The sensor 40 could be secured, for example, to a carriage on which the top drive 22 is mounted for displacement along the upper mast section 12*a*. Alternatively, the sensor 40 could detect revolutions of a motor used to displace the top drive 22. The scope of this disclosure is not limited to use of any particular type of sensor to sense the position of the top drive 22.

The sensors 42 in this example are included with the guide assemblies 26, with each of the guide assemblies comprising at least one of the sensors 42. The sensors 42 detect when the top drive 22 is proximate one of the guide assemblies 26. For example, each sensor 42 may be a proximity sensor, a Hall effect device, etc.

Note that it is not necessary for all of the sensors 40, 42 to be used. For example the sensor 40 could be used without the sensors 42, or the sensors 42 could be used without the sensor 40.

When the top drive 22 is descending and approaches a closed guide assembly 26, the controller 38 automatically operates the actuators 28 of the closed guide assembly to open the guide assembly. This prevents the top drive 22 from contacting the previously closed guide assembly 26. When the top drive 22 is ascending, the controller 38 automatically operates the actuators 28 of the open guide assemblies 26, so that the guide assemblies close after the top drive is displaced past each guide assembly. This ensures that the tubular string 24 is laterally supported against buckling as the top drive 22 ascends.

It may now be fully appreciated that the present disclosure provides significant benefits to the art of constructing and utilizing well rigs. In examples described herein, the rig 10 includes multiple guide assemblies 26 spaced apart along the mast 12 to prevent buckling of the tubular string 24.

The present disclosure provides to the art a well rig 10. In one example, the well rig 10 can comprise a mast 12, and multiple guide assemblies 26 distributed along the mast 12. The guide assemblies 26 are configured to laterally support a tubular string 24.

The well rig 10 may also include a top drive 22 displaceable along the mast 12, the top drive 22 being configured to axially displace the tubular string 24 relative to the mast 12.

The well rig 10 may include a position sensor 40 configured to sense a position of the top drive 22 along the mast 12, and a controller 38 configured to receive an output of the sensor 40 and to control operation of the guide assemblies 26 in response to the sensor 40 output.

The mast 12 may include first and second mast sections 12*a,b*, the first mast section 12*a* being pivotable relative to the second mast section 12*b*. The guide assemblies 26 may be distributed along the first mast section 12*a*. A top drive 22 may be mounted to the first mast section 12*a*.

Each of the guide assemblies 26 may include a guide 32 and an actuator 28 configured to displace the guide 32 between open and closed positions. In the open position the guide 32 may be configured to be spaced apart from the tubular string 24. In the closed position the guide 32 may be configured to contact and laterally support the tubular string 24. The actuator 28 may be configured to rotate the guide 32 between the open and closed positions.

Each of the guide assemblies 26 may include a sensor 42 configured to detect when a top drive 22 is proximate the guide assembly 26. The well rig 10 may include a controller 38 configured to receive outputs of the sensors 42 and to control operation of the actuators 28 in response to the outputs of the sensors 42.

The present disclosure also provides to the art a method of operating a well rig 10. In one example, the method comprises: mounting multiple guide assemblies 26 spaced apart along a length of a mast 12 of the well rig 10; and actuating each of the guide assemblies 26 between open and closed configurations. In the open configuration the guide assembly 26 does not laterally support a tubular string 24, and in the closed configuration the guide assembly 26 laterally supports the tubular string 24.

The actuating step may include the guide assemblies 26 being actuated to the open configuration in succession in response to a top drive 22 descending along the mast 12. The actuating step may include the guide assemblies 26 being actuated to the closed configuration in succession in response to a top drive 22 ascending along the mast 12.

The actuating step may include rotating a guide 32 of each of the guide assemblies 26 relative to the mast 12. The guides 32 may be configured to contact and laterally support a tubular string 24 in the closed configuration.

Each of the guide assemblies 26 may include a sensor 42 that detects when a top drive 22 is proximate the guide assembly 26. The actuating step may include actuating each of the guide assemblies 26 in response to an output of the respective sensor 42.

The well rig 10 may include a sensor 40 that detects a position of the top drive 22. The actuating step may include actuating the guide assemblies 26 in response to an output of the sensor 40.

The method may include raising the mast 12 by rotating a first section 12*a* of the mast relative to a second section 12*b* of the mast. The guide assemblies 26 may be spaced apart along the first mast section 12*a*.

Another method of operating a well rig 10 is disclosed. In one example, the method can comprise: mounting multiple guide assemblies 26 spaced apart along a length of a mast 12 of the well rig 10; and displacing a top drive 22 along the mast 12. The guide assemblies 26 open in succession as the top drive 22 descends along the mast 12, and the guide assemblies 26 close in succession as the top drive 22 ascends along the mast 12.

Each of the guide assemblies 26 laterally supports a tubular string 24 when the guide assembly 26 is closed. Each of the guide assemblies 26 does not laterally support the tubular string 24 when the guide assembly 26 is open.

The method may include a controller 38 actuating the guide assemblies 26 between open and closed configurations. The actuating step may include rotating a guide 32 of each of the guide assemblies 26 relative to the mast 12.

Each of the guide assemblies 26 may include a sensor 42 that detects when the top drive 22 is proximate the guide assembly 26. The actuating step may include actuating each of the guide assemblies 26 in response to an output of the respective sensor 42.

A sensor 40 may detect a position of the top drive 22. The actuating step may include actuating the guide assemblies 26 in response to an output of the sensor 40.

The method may include raising the mast 12 by rotating a first section 12*a* of the mast 12 relative to a second section 12*b* of the mast 12. The guide assemblies 26 may be spaced apart along the first mast section 12*a*.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well rig, comprising:

a mast; and multiple guide assemblies distributed along the mast, in which each of the guide assemblies comprises a guide configured to laterally support a tubular string, and in which the guide is configured to pivot about an axis which is parallel to a longitudinal axis of the tubular string.

2. The well rig of claim 1, further comprising a top drive displaceable along the mast, the top drive being configured to axially displace the tubular string relative to the mast.

3. The well rig of claim 2, further comprising a position sensor configured to sense a position of the top drive along the mast, and a controller configured to receive an output of the sensor and to control operation of the guide assemblies in response to the sensor output.

4. The well rig of claim 1, in which the mast comprises first and second mast sections, the first mast section being pivotable relative to the second mast section, and in which the guide assemblies are distributed along the first mast section.

5. The well rig of claim 4, in which a top drive is mounted to the first mast section.

6. The well rig of claim 1, in which each of the guide assemblies further comprises an actuator configured to displace the guide between open and closed positions.

7. The well rig of claim 6, in which in the open position the guide is configured to be spaced apart from the tubular string, and in the closed position the guide is configured to contact and laterally support the tubular string.

8. The well rig of claim 6, in which the actuator is configured to rotate the guide between the open and closed positions.

9. The well rig of claim 6, in which each of the guide assemblies further comprises a sensor configured to detect when a top drive is proximate the guide assembly.

10. The well rig of claim 9, further comprising a controller configured to receive outputs of the sensors and to control operation of the actuators in response to the outputs of the sensors.

11. A method of operating a well rig, the method comprising:

mounting multiple guide assemblies spaced apart along a length of a mast of the well rig; and actuating each of the guide assemblies between open and closed configurations, in which in the open configuration the guide assembly does not laterally support a tubular string, and in the closed configuration the guide assembly laterally supports the tubular string, in which each of the guide assemblies comprises a sensor that detects when a top drive is proximate the guide assembly, and in which the actuating comprises actuating each of the guide assemblies in response to an output of the respective sensor.

12. The method of claim 11, in which the actuating comprises the guide assemblies being actuated to the open configuration in succession in response to a top drive descending along the mast.

13. The method of claim 11, in which the actuating comprises the guide assemblies being actuated to the closed configuration in succession in response to a top drive ascending along the mast.

14. The method of claim 11, in which the actuating comprises rotating a guide of each of the guide assemblies relative to the mast.

15. The method of claim 14, in which the guides are configured to contact and laterally support the tubular string in the closed configuration.

16. The method of claim 11, further comprising raising the mast by rotating a first section of the mast relative to a second section of the mast, and in which the guide assemblies are spaced apart along the first mast section.

17. A method of operating a well rig, the method comprising:

mounting multiple guide assemblies spaced apart along a length of a mast of the well rig;

displacing a top drive along the mast, in which the guide assemblies open in succession as the top drive descends along the mast, and in which the guide assemblies close in succession as the top drive ascends along the mast; and actuating the guide assemblies between open and closed configurations, in which a sensor detects a position of the top drive, and in which the actuating comprises actuating the guide assemblies in response to an output of the sensor.

18. The method of claim 17, in which each of the guide assemblies laterally supports a tubular string when the guide assembly is closed.

19. The method of claim 18, in which each of the guide assemblies does not laterally support the tubular string when the guide assembly is open.

20. The method of claim 17, in which a controller actuates the guide assemblies between the open and closed configurations.

21. The method of claim 17, in which the actuating further comprises rotating a guide of each of the guide assemblies relative to the mast.

22. The method of claim 17, further comprising raising the mast by rotating a first section of the mast relative to a second section of the mast, and in which the guide assemblies are spaced apart along the first mast section.

* * * * *